US005086369A

United States Patent [19]

Lin

[11] Patent Number: 5,086,369

[45] Date of Patent: Feb. 4, 1992

[54] STATIC DISCHARGING DEVICE

[76] Inventor: Spencer B. Lin, 3311 Shelby St., Ontario, Calif. 91764

[21] Appl. No.: 521,240

[22] Filed: May 9, 1990

[51] Int. Cl.[5] ..... H05F 3/00

[52] U.S. Cl. ..... 361/220; 361/212; 174/5 SG

[58] Field of Search ..... 361/212, 220, 222-224; 174/5 R, 5 SB, 5 SG; 343/715, 880; 24/11 C, 11 HC; 294/25, 26; 128/381, 382, 384-389, 796

[56] References Cited

U.S. PATENT DOCUMENTS

| | | | |
|---|---|---|---|
| 2,277,187 | 3/1942 | Transtrom | 174/5 R |
| 2,311,276 | 2/1943 | Wilcox | 174/5 SB |
| 3,132,887 | 5/1964 | Martinez | 294/25 |
| 3,745,412 | 7/1973 | Ruff | 361/220 |
| 4,104,695 | 8/1978 | Hollis et al. | 361/220 |
| 4,466,313 | 8/1984 | Gardner | 294/25 |
| 4,619,275 | 10/1986 | Ross et al. | 361/220 |
| 4,625,213 | 11/1986 | Horn | 343/715 |
| 4,825,877 | 5/1989 | Kempe | 361/220 |

FOREIGN PATENT DOCUMENTS

| | | | |
|---|---|---|---|
| 0611734 | 6/1935 | Fed. Rep. of Germany | 24/11 C |
| 0902634 | 8/1962 | United Kingdom | 219/268 |

*Primary Examiner*—A. D. Pellinen
*Assistant Examiner*—Richard Elms

[57] ABSTRACT

This invention provides a static discharging device comprising a conductive antenna and a conductive retainer connected to each other, said retainer can be wore on any finger to make a quick and short tap on any metallic portion to discharge the static electricity.

8 Claims, 1 Drawing Sheet

STATIC DISCHARGING DEVICE

This application relates to a static discharging device, particularly to the static discharging device that can be wore on any suitable finger for quick operation.

The static electricity is generated by the friction of the human body against the textile products, such as garments or carpets. A shock will be caused by the static electricity when one touches the metallic portions, such as doorknobs, parts inside of the houses or elevators, and the like.

In order to avoid this accidental shock, it is better to discharge the static electricity by a quick and short tap with any metallic portion before one touches it.

Therefore, the primary object of this invention is to provide a static discharging device that can be wore on any finger to make a quick and short tap on any metallic portion to discharge the static electricity in a simple operation.

Other objects and features of this invention will be more clearly understood from the following description in detail with reference to the embodiments as shown in the accompanying drawings, in which.

Figure 1:
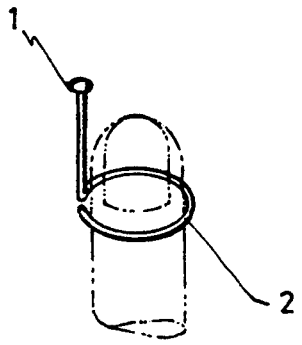
FIG. 1 is a perspective view of one embodiment of the static discharging device according to present invention, being wore on a finger as shown by two-dots-and-dash line.

Now, the reference is made to FIG. 1. The static discharging device according to the present invention comprises an antenna 1 and a retainer 2, both are made of conductive material. As shown, the antenna 1 has a smoothly rounded top end and the retainer 2 is in a form of open ring, one end of which is integrated with the bottom end of said antenna 1 and other end is terminated at a short distance from the juncture between said one end of the retainer 2 and the bottom end of said antenna 1. Therefore, the diameter of said retainer ring 2 is flexible so as to readily wear on any finger of different size till about first knuckle of the finger in the extent that the antenna 1 should be extended over the digital end, as shown in FIG. 1.

Figure 2:
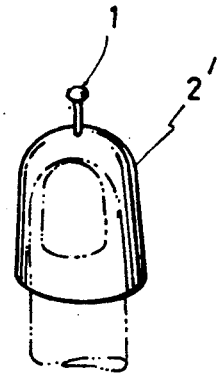
FIG. 2 is a perspective view of another embodiment, being wore on a finger as shown by two-dots-and-dash line.
Figure 3:
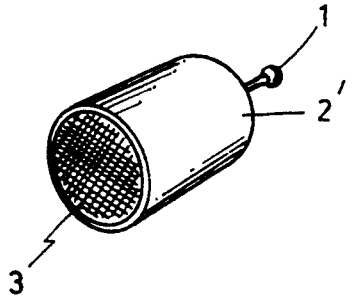
FIG. 3 is a bottom perspective view of the embodiment as shown in FIG. 2 to illustrate one of the inner structures.
Figure 4:
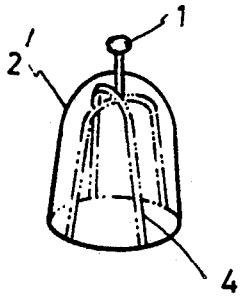
FIG. 4 is an elevational perspective view of the embodiment as shown in FIG. 2 to illustrate another inner structure.

FIG. 2 shows second embodiment of the static discharging device according to present invention, which consists of an antenna 1 having a smoothly rounded top end and a cap type retainer 2' which is capable of fitting onto any finger. The cap 2' may be made of plastic material or rubber by injection or extrusion moulding and embedded with a metallic net 3 which is connected with the bottom end of said antenna and exposed at inner side, as shown in FIG. 3, in contact with the finger that wears it. Alternatively, said net may be replaced by at least one pair of metallic wires 4 diagonally extended in elevational direction and preferably two pairs of wires crossing to each other, as shown in FIG. 4. Of course, the wires are exposed at inner side too and connected to the bottom end of said antenna 1, preferably at cross point in case of two pairs of wires being provided as shown.

Figure 5:
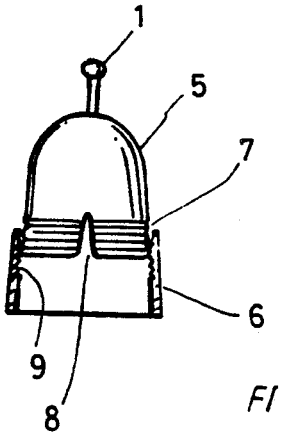
FIG. 5 is an elevational view with partial cross section of further embodiment.

Moreover, the cap type retainer may be formed in adjustable manner, according to further embodiment in FIG. 5. This adjustable cap consists of an upper section 5 and a lower section 6. The upper section 5 is either embedded with metallic net 3 as shown in FIG. 3 or with metallic wires 4 as shown in FIG. 4. Anyway, the upper section 5 is formed with male thread 7 at lower end and at least one slit 8 at said thread portion in elevational direction, preferably two slits 8 at diagonal position. The lower section 6 is correspondingly formed with female thread 9 in mate with said male thread 7, so that the lower section 6 can be turned in relation to said upper section 5. Both upper and lower sections 5,6 are slightly tapered, in such way that when said lower section 6 is turned downwardly with respect to said upper section 5, said upper section 5 at lower portion having said slit 8 will be slightly contracted for a smaller finger. In contrast, when said lower section 6 is turned upwardly with respect to said upper section 5, said upper section 5 at lower portion will be slightly expanded for a greater finger, by the inherent elastic property of the plastic material or rubber.

In use, the present static discharging device is readily wore on any suitable finger. The user may proceed a quick and short contact by means of the antenna onto any metallic portion to discharge the static electricity.

The aforementioned embodiments serve only for illustrative purposes and by no means restrict the scope of the present invention as defined in the appended claims.

What I claim is:

1. A static discharging device comprising a conductive antenna and a conductive retainer connected to each other, said retainer being worn on a finger, said antenna having a longitudinal axis extending in a direction of the finger and having a length in said direction extending past a digital end of the finger, so that said antenna extends over a digital end of the finger, wherein said retainer comprises a cap made of a plastic material and a conductive member embedded in said cap and exposed at inner side, said conductive member connected to said retainer.

2. The device as set forth in claim 1, wherein said conductive member is a metallic net.

3. The device as set forth in claim 1, wherein said conductive member is at least a pair of metallic wires diagonally extended in an elevational direction.

4. The device as set forth in claim 1, wherein said cap consists of an upper section and a lower section, both are slightly tapered, said upper section is formed with male thread at lower portion and at least one slit in elevational direction at said male thread whereas said lower section is correspondingly formed with female thread in mate with said male thread so that said lower section can be turned in relation to said upper section for an appropriate adjustment to suit any finger to wear said retainer.

5. A static discharging device comprising a conductive antenna and a conductive retainer connected to each other, said retainer being worn on a finger, said antenna having a longitudinal axis extending in a direction of the finger and having a length in said direction extending past a digital end of the finger, so that said antenna extends over the digital end of the finger, wherein said retainer comprises a cap made of rubber, and a conductive member embedded in said cap and exposed at inner side, said conductive member is connected to said antenna.

6. The device as set forth in claim 5, wherein said conductive member is a metallic net.

7. The device as set forth in claim 5, wherein said conductive member is at least a pair of metallic wires diagonally extending in an elevational direction.

8. The device as set forth in claim 5, wherein said cap consists of an upper section and a lower section, both are slightly tapered, said upper section is formed with a male thread at lower portion and at least one slit in elevational direction at said thread portion whereas said lower section is correspondingly formed with female thread in mate with said male thread so that said lower section can be turned in relation to said upper section for an appropriate adjustment to suit any finger to wear said retainer.

* * * * *